US010842257B2

(12) United States Patent
Fletcher-Price et al.

(10) Patent No.: US 10,842,257 B2
(45) Date of Patent: Nov. 24, 2020

(54) HEIGHT ADJUSTABLE DESK FOR PLACING ON AN EXISTING DESKTOP

(71) Applicant: Posturite Ltd., Berwick (GB)

(72) Inventors: Ian George Fletcher-Price, Eastbourne (GB); Stefan Knox, Billingshurst (GB); Theodore Davies, Bristol (GB); Andreas Lolle, Amager (DK); Steffen Nielsen Osterberg, Copenhagen (DK)

(73) Assignee: Posturite Ltd., Berwick (GB)

( * ) Notice: Subject to any disclaimer, the term of this patent is extended or adjusted under 35 U.S.C. 154(b) by 0 days.

(21) Appl. No.: 16/505,643

(22) Filed: Jul. 8, 2019

(65) Prior Publication Data

US 2020/0015584 A1 Jan. 16, 2020

(30) Foreign Application Priority Data

Jul. 10, 2018 (GB) ..... 1811267.2

(51) Int. Cl.
*A47B 9/16* (2006.01)
*A47B 9/02* (2006.01)
(Continued)

(52) U.S. Cl.
CPC ..... *A47B 9/16* (2013.01); *A47B 9/02* (2013.01); *A47B 21/02* (2013.01); *A47B 2009/006* (2013.01)

(58) Field of Classification Search
CPC ..... A47B 9/16; A47B 9/02; A47B 21/02
See application file for complete search history.

(56) References Cited

U.S. PATENT DOCUMENTS 5,588,377 A * 12/1996 Fahmian ..... A47B 9/00 108/145
8,544,391 B2 * 10/2013 Knox ..... B60N 3/063 108/12

(Continued)

FOREIGN PATENT DOCUMENTS

CN 206729526 12/2017
KR 10-1827676 2/2018

OTHER PUBLICATIONS

Posturite, Oplift Sit-Stand Platform, posturite.co.uk/oploft-sit-stand-platform.html [accessed Jul. 8, 2019].

(Continued)

*Primary Examiner* — Daniel J Rohrhoff
(74) *Attorney, Agent, or Firm* — Levy & Grandinetti

(57) ABSTRACT

There is provided a height adjustable desk (5) for placing on an existing desktop. The height adjustable desk (5) comprises a base frame (50) for placing on the existing desktop, a desktop (10) that is connected to the base frame (50) by first (40) and second (45) support members, and a gas strut, wherein the first and second support members (40, 45) are pivotally connected (41) to one another and are pivotable about the pivotal connection to raise and lower the desktop (10) from the base frame (50). The ends of the second support member (45) are slidable along the base frame (50) and along the desktop (10), and one of those ends is pivotably connected to a shuttle, the shuttle being drivable by the gas strut to slide along a shuttle frame of the desktop or base frame.

18 Claims, 6 Drawing Sheets

(51) Int. Cl.
*A47B 21/02* (2006.01)
*A47B 9/00* (2006.01)

(56) References Cited

U.S. PATENT DOCUMENTS

| | | | | |
|---|---|---|---|---|
| 9,054,316 | B2 * | 6/2015 | Aonuma | C23C 14/086 |
| 9,480,332 | B2 * | 11/2016 | Han | A47B 9/02 |
| 9,681,746 | B1 * | 6/2017 | Chen | A47B 9/02 |
| 10,244,861 | B1 * | 4/2019 | Poniatowski | A47B 9/16 |
| 10,258,148 | B1 * | 4/2019 | Donner | A47B 21/02 |
| 10,575,630 | B1 * | 3/2020 | Poniatowski | A47B 21/04 |
| 2004/0040480 | A1 * | 3/2004 | Hwang | A47B 3/02 108/145 |
| 2014/0041554 | A1 * | 2/2014 | Huang | A47B 3/02 108/50.11 |
| 2016/0286951 | A1 * | 10/2016 | Chung | A47B 3/02 |
| 2016/0338486 | A1 * | 11/2016 | Martin | A47B 9/16 |
| 2018/0103752 | A1 * | 4/2018 | Zhong | A47B 3/02 |
| 2018/0146775 | A1 * | 5/2018 | You | A47B 9/16 |
| 2018/0184797 | A1 * | 7/2018 | Chuang | A47B 9/16 |
| 2018/0255919 | A1 * | 9/2018 | Swartz | A47B 9/02 |
| 2018/0360208 | A1 * | 12/2018 | Liao | A47B 13/00 |
| 2019/0038015 | A1 * | 2/2019 | Huang | A47B 9/16 |
| 2020/0029685 | A1 * | 1/2020 | Du | A47B 21/02 |

OTHER PUBLICATIONS

Posturite, Apr. 20, 2016, Oploft Sit-Stand Platform, kickstarter.com.

* cited by examiner

HEIGHT ADJUSTABLE DESK FOR PLACING ON AN EXISTING DESKTOP

FIELD OF THE INVENTION

The present invention relates to a height adjustable desk, in particular a height adjustable desk that can be placed on top of an existing desktop to raise the height of the desktop.

BACKGROUND OF THE INVENTION

One of the problems with existing desks is that they are often not adjustable in height, and so do not always meet the ergonomic requirements of the user of the desk. If the user is in a sitting position on a chair, then the height of the chair may be adjusted to move the user to a comfortable position relative to the desktop. However, if the user wishes to stand instead of sit, then an adjustable chair is of no use. The user may also wish to alternate between standing and sitting positions, as remaining fixed in a single position for a long period of time may have negative health consequences for the user.

It is known to provide a height adjustable desk that can be placed on top of an existing desktop, to raise and lower the overall height of the desktop. However, such known height adjustable desks are typically difficult or complicated to operate, or need to be permanently fixed to the existing desktop rather than simply placed upon it.

It is therefore an object of the invention to provide an improved height adjustable desk for placing on top of an existing desktop.

SUMMARY OF THE INVENTION

According to the invention, there is provided a height adjustable desk for placing on an existing desktop. The height adjustable desk comprises a base frame for placing on the existing desktop, a desktop that is connected to the base frame by first and second support members, and a gas strut, wherein the first and second support members are pivotally connected to one another and are pivotable about the pivotal connection to raise and lower the desktop from the base frame. The height adjustable desk has a front side, a rear side, and a top side formed by the desktop. A lower end of the first support member is pivotally connected to the base frame at the front side of the height adjustable desk, and an upper end of the first support member is pivotally connected to the desktop at the rear side of the height adjustable desk. A lower end of the second support member is slidable along the base frame, and an upper end of the second support member is slidable along the desktop. The upper or lower end of the second support member is pivotably connected to a shuttle, the shuttle being drivable by the gas strut to slide along a shuttle frame of the desktop or base frame.

The gas strut makes the desktop easy to raise and lower relative to the base frame, even when a large weight such as a computer monitor is placed upon the desktop. The first and second support members pivot relative to one another in a scissoring action to increase and reduce the space between the desktop and the base frame. Preferably, the desktop can be fully lowered all the way down to the base frame, making the height adjustable desk very thin so the desktop is at a similar height to the existing desktop upon which the height adjustable desk is placed. For example, the height adjustable desk may have a total height of less than 0.1 m when the desktop is fully lowered toward the base frame, and can be easily transported.

Since the ends of the first support member are pivotally connected to the base frame at the front of the height adjustable desk, and the desktop at the rear side of the height adjustable desk, when the desktop is raised upwardly the first support member also causes the desktop to move in a forward direction, horizontally towards the user. This also assists the user in raising the desktop, considering that the user's hands/arms are most easily drawn forwards towards the user's shoulders, rather than directly upwardly. These pivotal connections are preferably formed by pivots connected between the first support member and the desktop/base frame, and each pivot remains in a fixed axis throughout the raising and lowering of the desktop relative to the base frame.

Allowing the ends of the second support member to slide along the base frame and the desktop allows the forward movement of the desktop to take place, whilst maintaining the desktop surface in a horizontal plane. One end of the second support member may slide along support rails of the desktop or base member, and the other end of the second support member may be pivotally connected to the shuttle. The support rails prevent movement of that end of the second support member relative to the support rails in the height direction.

The height adjustable desk may comprise more than one first support member, and more than one second support member. For example, there may be two second support members positioned adjacent to one another, and two first support members positioned either side of the second support members, with adjacent ones of the first and second support members being pivotally connected to one another. Preferably, these pivotal connections of the first and second support members to one another are mid-way along the lengths of the first and second support members. The first and second support members preferably have a width of at least four times greater than a depth, where the width dimension is parallel to the pivot axis, to help stabilise the desktop from moving in left and right side directions when the desktop is raised upwardly from the base frame.

To effect a certain change in height of the desktop, the shuttle may need to move a smaller distance when the desktop is in a lower position, and a greater distance when the desktop is in a higher position, due to the pivoting action of the first and second support members. In other words, there may be more leverage on the gas strut when the desktop is in the lower position, compared to when the desktop is in the higher position, and the gas strut may need to exert a higher force on the shuttle to raise the desktop when the desktop is in the lower position, compared to when the desktop is in the higher position. To help compensate for this, the height adjustable desk may further comprise a spring that biases the pivotal connection of the first and second support members towards raising the desktop upwardly from the base frame. The spring is preferably configured to exert more force when the desktop is in the lower position, compared to when the desktop is in the higher position, to assist the gas strut in raising the desktop from the lower position. The spring also helps to damp the downward movement of the desktop when it is lowered towards the base frame. For example, the spring may be a coiled spring such as a helical torsion spring, with the pivot connecting the first and second support members passing through the coils of the spring.

To further compensate for the increased leverage on the gas strut when the desktop is in low positions, the desktop or the base frame may comprise a damper spring that comes into contact with the first or second member as the desktop is lowered to the base frame, and biases the desktop upwardly away from the base frame. The damper spring also helps to cushion and/or damp the movement of the desktop towards the base frame in the final part of travel of the desktop towards the base frame.

The gas strut may comprise a gas strut handle that is actuable to cause the gas strut to drive the shuttle along the shuttle frame, to raise the desktop from the base frame. Some assistance in raising the desktop from the base frame may need to be provided by the user, depending on how much weight is placed on the desktop. Gas struts which can be actuated to extend a piston of the gas strut from a main body of the gas strut are well known, and preferably the main body is connected to the shuttle, and the piston is connected to the desktop or the base frame, depending on whether the gas strut is mounted to the desktop or to the base frame. Preferably, the gas strut is mounted to the desktop, along with the gas strut handle, so the handle can be easily accessed by the user.

The pistons of many gas struts resist further movement once they are no longer actuated, and so this can help to hold the desktop at whichever height the user wishes. However, to help hold the desktop at the required height, the shuttle is preferably provided with a retainer device for retaining the shuttle at a selected one of a plurality of alternate positions along the shuttle frame. Each alternate position corresponds to a respective height of the desktop above the base frame.

The retainer device may comprise a retainer handle that is actuable to release the shuttle from the selected one of the plurality of alternate positions along the shuttle frame, allowing the shuttle to be slid to another one of the plurality of alternate positions. Preferably, the retainer device comprises a retainer pin controlled by the retainer handle, and a plurality of holes in the shuttle for receiving the retainer pin, the plurality of holes corresponding to respective ones of the plurality of alternate positions. The retainer pin is spring biased towards the holes, and the retainer handle can be actuated to move the pin against the spring bias and out of whichever hole it is currently in, to release the shuttle and allow a different height of the desktop and different hole of the shuttle to be selected by releasing the retainer handle.

When both the gas strut handle and the retainer handle are implemented, both may need to be actuated at the same time to allow upward/downward movement of the desktop relative to the base frame, since otherwise whichever one is not actuated will prevent movement of the desktop. Placing the gas strut handle and the retainer handle at opposite sides of the device provides a safety feature that prevents the user from putting their fingers between the first and second support members where their fingers could become trapped during upward/downward movement of the desktop, since the user must use both hands to operate the to the gas strut handle and the retainer handle simultaneously.

When the desktop is moved into its lowermost position relative to the base frame, the first and second support members may extend substantially horizontally, i.e. parallel to the existing desk surface, and the influence of the gas strut and/or springs may cause the desktop to slope, rather than remaining horizontal. To help prevent the desktop from sloping, the gas strut handle and/or the retainer handle may comprise a latch that is configured to latch against the base frame when the desktop is fully lowered to the base frame, and configured to release when the handle is actuated to allow the desktop to rise up from the base frame.

The gas strut handle and/or retainer handle may each be pivotally mounted to the desktop, and have a bottom portion extending beneath the desktop, the bottom portion comprising the latch at one end of the portion, and a further latch at an opposite end of the portion. The latch and the further latch are configured to latch against opposing sides of a base member of the base frame when the desktop is fully lowered to the base frame, and to release when the gas strut handle is actuated to allow the desktop to rise up from the base frame. The use of these two latches, which may have the pivotal connection of the handle to the desktop positioned between them, helps secure the desktop in its lowermost position.

The gas strut handle and/or retainer handle may each comprise a skirt portion that extends downwardly from the desktop and which prevents entry of a user's fingers between the desktop and the base frame when actuating the handle. This helps prevent injury to the user's fingers, for example when lowering the desktop into its lowermost position on the base frame, whilst actuating both of the handles.

The gas strut handle and/or retainer handle may each comprise a grip portion that is mounted on top of the desktop, and which is grasped by a user to actuate the handle. The handle may be connected to the main body of the gas strut or retainer pin by a cable running from the handle to the gas strut or the retainer pin, the cable transmitting the motion of the handle to the gas strut or the retainer pin for actuating those elements.

For example, each handle may be pivotally connected to the desktop by each handle comprising a pivot portion that passes vertically downwards through an aperture in the desktop, the grip portion being connected to the pivot portion above the desktop, and the bottom portion having the latches and the skirt being connected to the pivot portion beneath the desktop, so that the user can grasp and rotate the handle portion to release the latches, and actuate the gas strut and retainer pin. Preferably, the cable is connected to the bottom portion having the latches, beneath the desktop.

DETAILED DESCRIPTION

Embodiments of the invention will now be described by way of non-limiting example only and with reference to the accompanying drawings, in which.

The figures are not to scale, and same or similar reference signs denote same or similar features.

Figure 1:
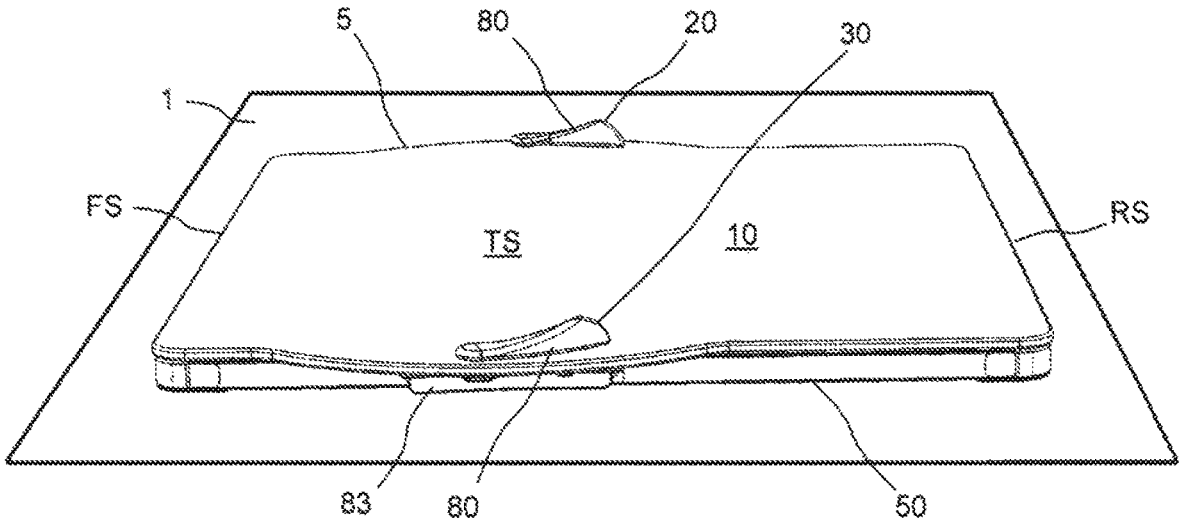
FIG. 1 shows a schematic perspective diagram of a height adjustable desk according to an embodiment of the invention when in a fully lowered position and when placed upon an existing desktop, when viewed from the side.

Various embodiments of the invention will now be described with reference to FIGS. 1 to 8, which show a height adjustable desk 5. Referring to FIG. 1, the height adjustable desk 5 is shown in a fully lowered position, placed upon an existing desktop 1. The existing desktop 1 is part of a computer desk in this embodiment, and the user of the computer desk has placed the height adjustable desk 5 on the desktop 1 to help raise the height of the desktop. Specifically, the height adjustable desk 5 provides a desktop 10 which the user can use in place of the desktop 1. Since the height adjustable desk 5 is shown in a fully lowered position, the height of the desktop 10 is very similar to the height of the desktop 1, and so the user can use the desktop 10 in a very similar manner to the desktop 1, for example by sitting at the computer desk in their normal position.

The height adjustable desk 5 comprises a front side FS, which is placed closest to the user, a rear side RS, which is placed furthest from the user, and a top side TS, which is defined by the desktop 10 and which the user can work on. For example, the user may place a computer monitor on the top side TS. The top side TS is a flat, planar surface, provide by the top surface of the desktop 10. The desktop 10 rests upon a rectangular base frame 50, and so is stable and can easily support a large amount of weight. In this embodiment, the base frame extends directly beneath the periphery of the desktop 10, to help provide stability.

The desktop 10 is substantially rectangular, similar to the base frame, and so provides a substantially rectangular work surface at the top side TS. Typically, the desktop 10 is formed of metal or wood, although alternate materials could also be used. Other shapes besides rectangular shapes for the desktop and base frame could also be implemented if desired.

At the left side of the height adjustable desk 5, as viewed by the user at the front side FS, there is a gas strut handle 20, and at the right side of the height adjustable desk 5, as viewed by the user at the front side FS, there is a retainer handle 30. The retainer handle 30 is a mirror image of the gas strut handle 20, and so the two handles are substantially the same as one another. The two handles differ in function, in that they control different elements of the height adjustable desk 5 to one another. Each handle 20, 30 has a grip portion 80 which is mounted on the top surface of the desktop 10, and which the user may grip to rotate the handle and raise the height of the desktop 10. Specifically, the left side handle can be rotated anticlockwise by the user and the right side handle simultaneously rotated clockwise by the user to release the desktop 10 from the base frame 50 and allow it to be raised.

This configuration allows the user to pull the grip portions 80 outwardly with their thumbs, whilst their fingers extend beneath the desktop 10, and exert upward force to raise the desktop 10. Each handle also comprises a skirt portion 83 which extends beneath the desktop 10. The skirt portion 83 overlaps the base frame 50 outside the peripheral side edges of the base frame 50, and so stops the user's fingers from entering in between the desktop 10 and the base frame 50 as the desktop 10 is lowered back towards the base frame 50, to keep the user's fingers safe from becoming trapped.

The handles 20, 30 are positioned on opposite side of the desktop 10 to one another, so the user has to use one hand to operate the handle 20, and a their other hand to operate the handle 30. The handles 20, 30 are positioned close to the front side of the desktop 10 than to the rear side of the desktop 10, allowing the user to more easily reach the handles when working at the desk.

Figure 2:
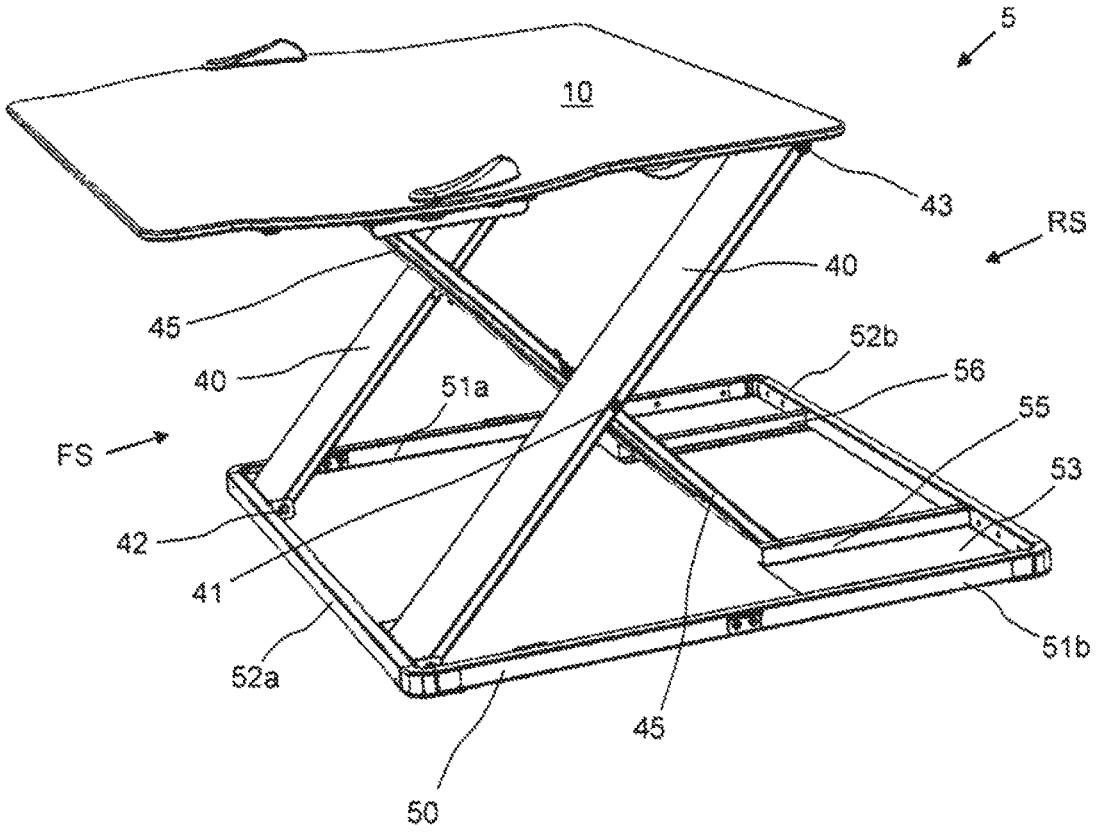
FIG. 2 shows a schematic perspective diagram of the height adjustable desk of FIG. 1 in a fully raised position when viewed from above.

The schematic perspective diagram of FIG. 2 shows the height adjustable desk 5 in a fully raised position, when viewed from above. In this position the height adjustable desk 5 still sits in the same place on the existing desktop 1 as in FIG. 1, but the existing desktop 1 is not shown in FIG. 2 (nor in FIGS. 3 to 8) for the sake of clarity. The user raises the desktop 10 to the fully raised position of FIG. 2 by actuating the handles 20, 30 and lifting the desktop 10 upwardly from the position shown in FIG. 1, for example so they can work in a standing position at the computer desk instead of working in a sitting position The base frame 50 comprises a rectangular framework defined by a front member 52*a*, a rear member 52*b*, a left side member 51*a*, and a right side member. These members are elongate shafts which all rest on the existing desktop, and run parallel to the existing desktop. The ends of the left and right side members 51*a* and 51*b* meet the ends of the front and rear side members 52*a* and 52*b* at the corners of the based frame 50. At the rear side of the height adjustable desk 5, two rails 55 extend inwardly from the rear member 52*b* towards the front member 52*a*, and each rail 55 is supported by a respective plate 53 that extends between the rail, the rear member 52*b* and the side member (either the left side member 51*a* or the right side member 51*b*, depending on the rail in question). Each rail 55 defines an elongate slot 56, and the slots 56 of the rails 55 are open in directions facing towards one another, and defined by sides of the rails that extend above and below the slots, parallel to the elongation of the rails.

The height adjustable desk 5 further comprises a first member 40, and a second member 45 which is pivotally connected to the first member 40 by a pivot 41. The axis of the pivot 41 is parallel to the front and rear members 52*a* and 52*b*, and the pivot 41 is connected mid-way along the lengths of both the first and second members 40 and 45.

The first and second members 40 and 45 are elongate shafts which extend from the base frame 50, to the desktop 10. The first and second members each have a width parallel to the front and rear members 52*a* and 52*b*, a length extending from the base from 50 to the desktop 10, and a thickness perpendicular the width and length dimensions. In this embodiment, the widths of the first and second members are much greater than the thicknesses of the first and second members, to provide structural rigidity.

In this embodiment there are two sets of the first and second members, one set at the left side of the height adjustable desk 5 and another set at the right side of the height adjustable desk 5. Both of the second members 45 are positioned in between the two first members 40. The first member 40 of each set pivots about the pivot 41 with respect to the second member 45 of the set, in a scissoring action as the desktop 10 is raised or lowered from the base frame 50.

The lower end of each first member 40 is pivotally connected to the base frame 50 at the front side FS of the height adjustable desk 5, by pivots 42. The pivots 42 extend from the lower end of first member and into two brackets mounted on the inner side edges of the front member 52*a*, the brackets spaced apart by the width of the first member. The axis of each pivot 42 is parallel to the axis of the pivot 41.

The upper end of each first member 40 is pivotally connected to the desktop 10 at the rear side RS of the height adjustable desk 5, by pivots 43. The pivots 43 extend into a bracket 43*a* (see FIG. 4) that is mounted to the underside of the desktop 10, and the axis of each pivot 43 is parallel to the axes of the pivots 41 and 42.

The lower ends of the second members 45 have a pivot 46 (see FIG. 4) which extends into the openings 56 of the rails 55. In this embodiment, the pivot 46 extend all the way from one of the slots 56 to the other slot 56, via both of the second members. This helps to provide structural rigidity to the second members, but separate pivots 46 for each one of the second members 45 could be implemented if desired. The pivot 46 is able to slide along the slots 56, parallel to the left and right side members 51*a* and 51*b*, meaning that the lower ends of the second members 45 are able to slide along the base frame 50 as the desktop 10 is raised or lowered from the base frame 50.

The upper end of each second member 45 has a pivot 47 (see FIG. 4), which extends into the opening of a slot in a respective rail 12, the rail 12 being mounted to the underside of the desktop. The rail 12 is similar to the rail 55. There are two rails 12, one for each second member, and the openings of the slots of the rails 12 face towards one another. Each pivot 47 is able to slide along the slot in the respective rail 12, parallel to the left and right side members 51*a* and 51*b*, meaning that the upper ends of the second members 45 are able to slide along the desktop 10 as the desktop 10 is raised or lowered from the base frame 50.

In this embodiment, there is a separate pivot 47 for each one of the second members, however a single pivot extending all the way from the slot in one of the rails 12 to the slot in the other of the rails 12 via both of the second members could be implemented if desired and if conflict between such a single pivot and a piston 71 (see FIG. 4) of a gas strut 70 (see FIG. 5) could be avoided.

Figure 3:
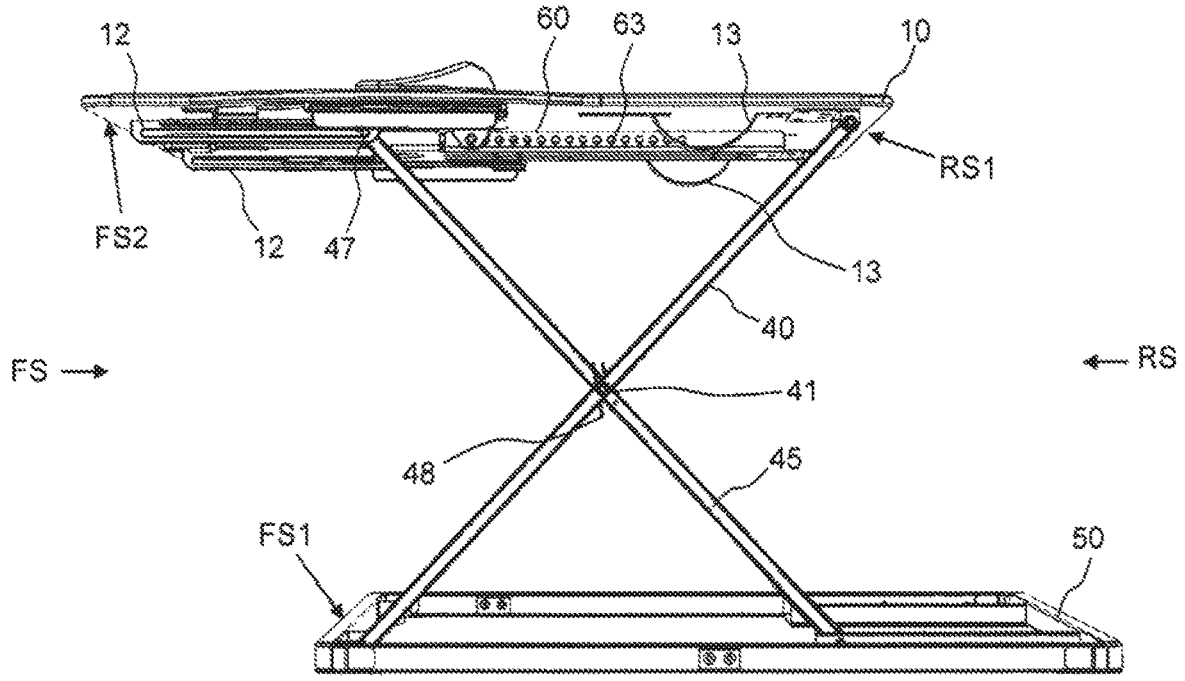
FIG. 3 shows a schematic perspective diagram of the height adjustable desk of FIG. 1 in the fully raised position when viewed from the side.

The schematic diagram of FIG. 3 shows a view from the right side of the height adjustable desk 5 when in the fully extended position. Since the ends of the first members 40 are fixed to the front side of the base frame 50 at FS1 and the rear side of the desktop 10 at RS1, and the ends of the second members 45 are allowed to slide relative to the base frame 50 and the desktop 10, when raising the desktop 10 from the position shown in FIG. 1 to the position shown in FIG. 3, the desktop 10 is forced to move both upwardly and forwardly. Specifically, it can be seen in FIG. 1 that the front edge of the base frame 50 is just as far forward as the front edge of the desktop 10, whereas in FIG. 3 it can be seen that the front edge of the desktop 10 at FS2 has moved forward (i.e. to the left as shown in FIG. 3) relative to the front edge of the base frame 50 at FS1. This forward motion makes the desktop 10 easier for the user to raise upwardly.

Also visible in FIG. 3 is a coiled (helical) torsion spring 48 through which the pivot 41 connecting the first and second members 40 and 45 together passes. The spring 48 is located in between the first and second members (see FIG. 5), and biases the first and second members to move away from being in parallel with one another. This helps to assist the user in raising the desk upwardly form the base frame 50.

Figure 4:
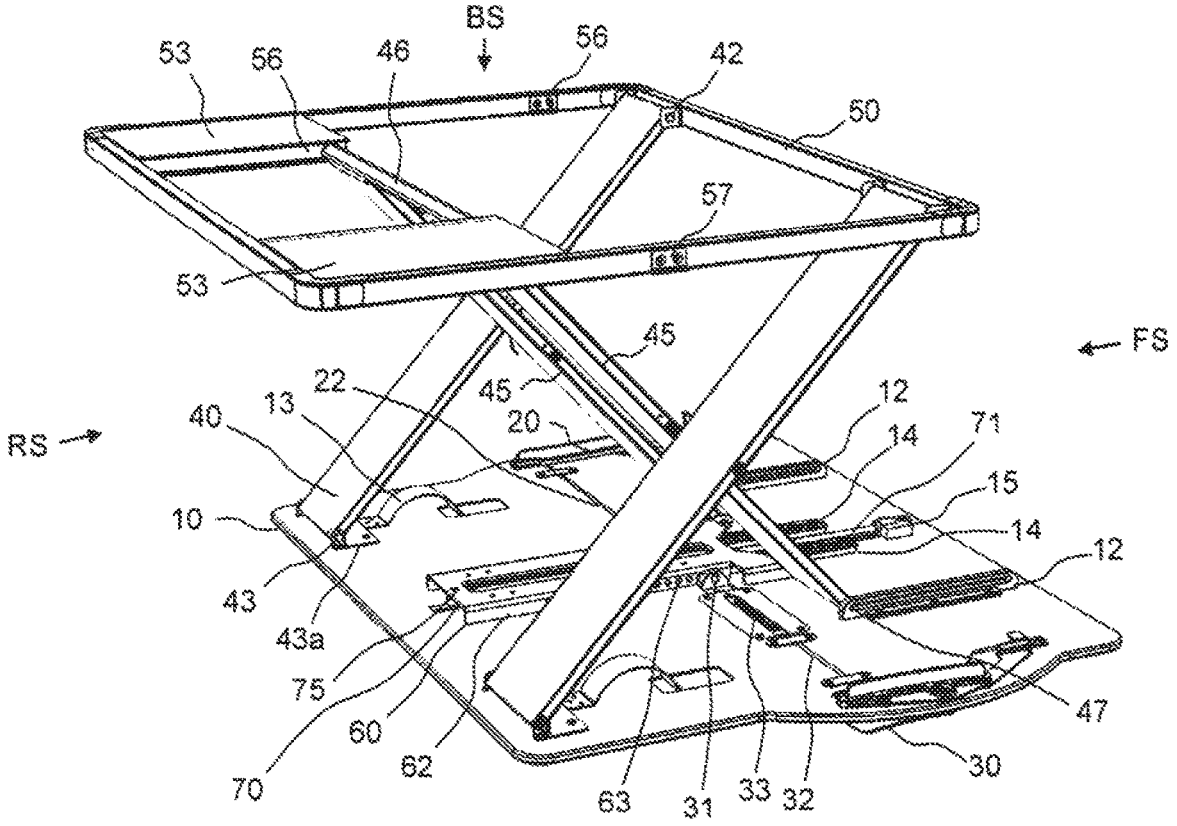
FIG. 4 shows a schematic perspective diagram of the height adjustable desk of FIG. 1 in the fully raised position when viewed from below.

Also visible in FIG. 3 are two damping springs 13, which are mounted to the underside of the desktop 10. Each damping spring 13 is a curved resilient member, which has opposing ends fixed to the underside of the desktop 10, and which curves downwardly in a direction towards the base frame 50. Each damping spring 13 may for example be made from a flexible plastics material. Each damping spring is mounted to the underside of the desktop 10 at a position that is directly above one of the first members 40, as can be seen in FIG. 4. In this embodiment, the damping springs 13 are mounted slightly forwardly of where the first members 40 connect to the desktop 10.

The upper ends of the first members 40 move into contact with the damping springs 13 when the desktop 10 is lowered towards the base frame 50. Accordingly, the damping springs 13 both cushion the impact of the desktop 10 when it reaches its lowermost position, and provide upward force on the desktop 10 that assists the user in raising the desktop 10 upwardly from its lowermost position.

Also visible in FIG. 3 is a shuttle 60 with holes 63. The shuttle 60 is driven by the gas strut 70, based on control from the gas strut handle 20, to raise and lower the desktop 10 from the base frame 50. The holes 63 in the shuttle allow the shuttle to be locked in various positions based on control from the retainer handle 30, the various positions corresponding to various heights of the desktop 10 above the base frame 50.

The schematic diagram of FIG. 4 shows further details of the shuttle 60. Specifically, the shuttle 60 in this embodiment is a U-shaped plate which slides perpendicular to the axes of the pivots 41, 42, 46, and 47. The shuttle slides along a shuttle frame in the form of two rails 14, which are mounted to the underside of the desktop 10, and which run parallel to the left and right side members 51*a* and 51*b*. The gas strut 70 is mounted in between the rails 14, and inside the U shape of the shuttle 80. Specifically, the gas strut 70 comprises a main body which is connected to the rearward end of the shuttle 60 by a bolt 75, and a piston 71 which is connected to the underside of the desktop 10 by a mounting bracket 15 adjacent the front of the desktop 10. Accordingly, motion of the piston 71 inward and outward of the main body of the gas strut 70 causes the shuttle 60 to slide forwardly and rearwardly, respectively.

Figure 6:
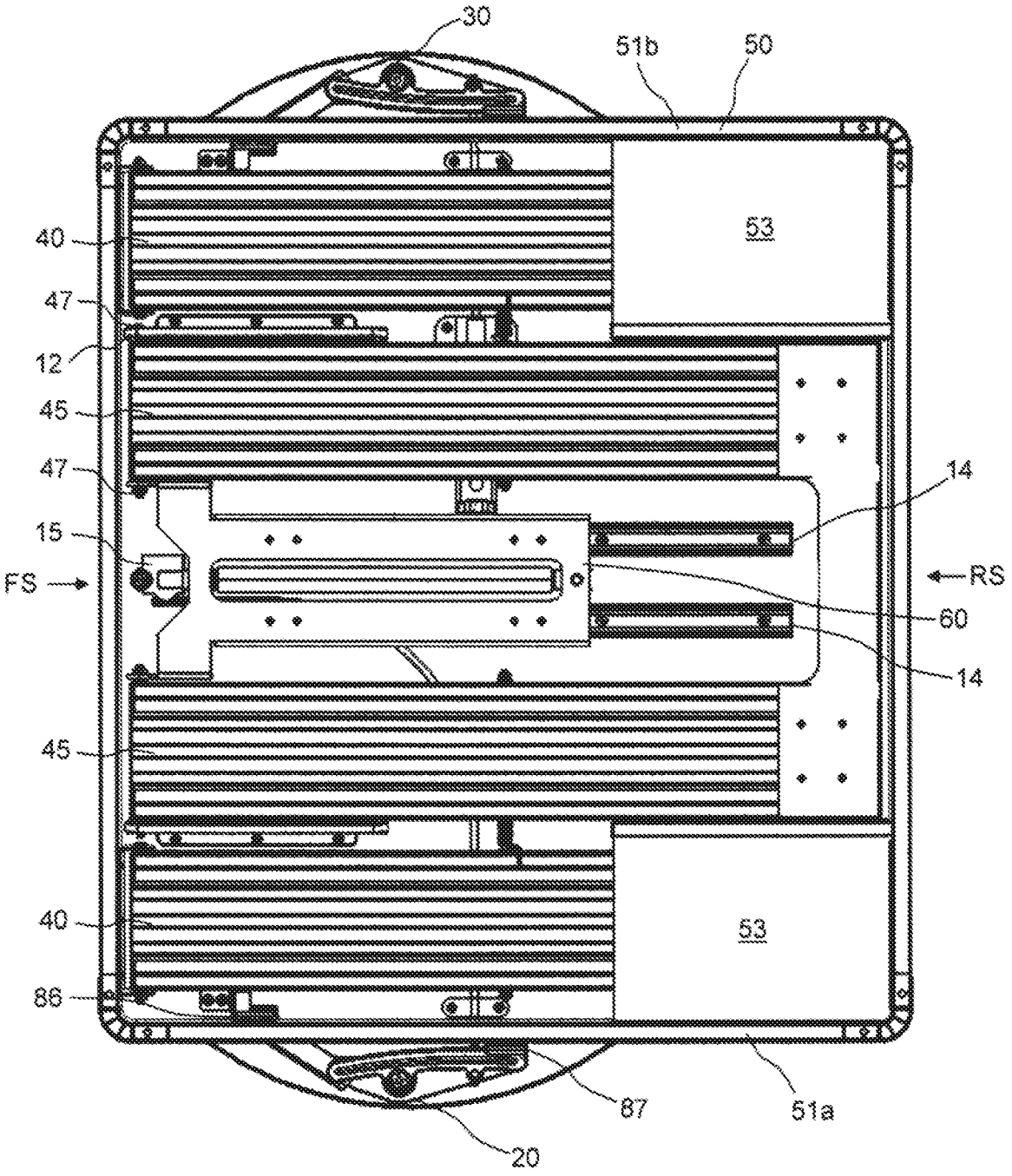
FIG. 6 shows a schematic bottom plan view of the height adjustable desk of FIG. 1 in the fully lowered position when viewed from below.

As best seen in FIG. 6, the pivots 47 that connect the ends of the second members 45 to the rails 12 on the underside of the desktop 10, are also pivotally connected to the shuttle 60. Specifically, each pivot 47 passes from the opening in the rail 12, through the width of the respective second member 45, and into an opening in the shuttle 60. In alternate embodiments, separate pivots 47 could be implemented at opposite sides of each second member 45, instead of using a single pivot that passes fully through each second member 45.

Since the shuttle 60 is connected to the second members 45 by the pivots 47, movement of the shuttle 60 along the rails 14 causes the upper ends of the second members 45 to slide along the rails 12. Due to the pivots 41 that connect the second members 45 to the first members 40, the lower ends of the second members 45 slide along the rails 55 of the base frame 50, and the desktop 10 is forced upwardly/downwardly, and also forwardly/rearwardly by the pivotal connections 43 and 42 of the first members 40 to the desktop 10 and the base frame 50.

The motion of the shuttle 60, and therefore the raising and lifting of the desktop 10, is controlled by the gas strut handle 20 and the retainer handle 30 (see FIG. 1). Specifically, as shown in FIG. 4, the gas strut handle is connected to the gas strut by a cable 22, and the retainer handle 30 is connected to a retainer pin 31 by a cable 32. The gas strut 70 is configured to remain in its current position until the gas strut handle 20 is actuated, and upon actuation of the gas strut handle 20, the gas strut 70 forces the piston 71 outwardly from the main body of the gas strut, forcing the shuttle 60 in a rearward direction, and making the desktop 10 much easier for the user to lift than if the gas strut was not present.

Figure 5:
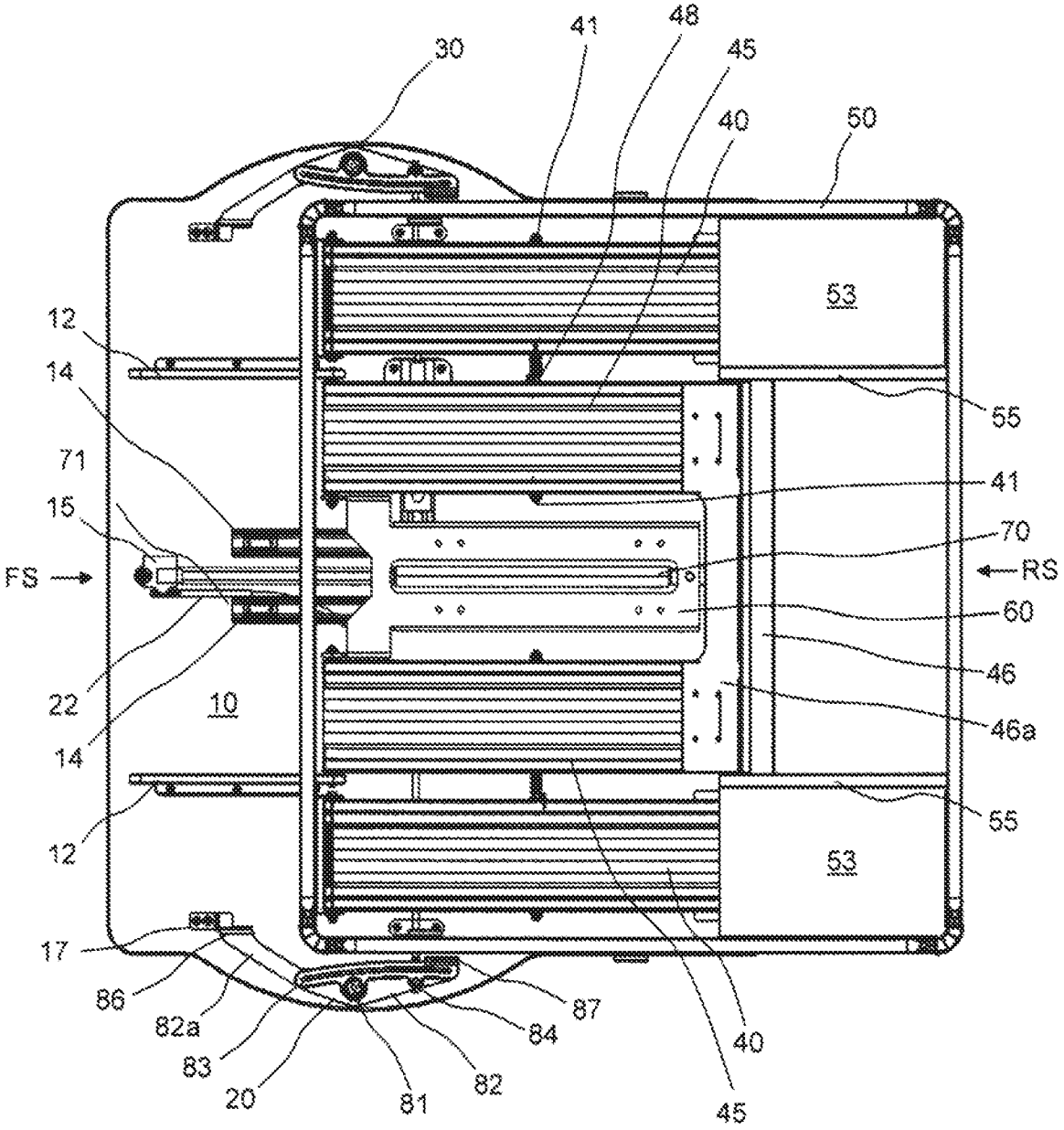
FIG. 5 shows a schematic bottom plan view of the height adjustable desk of FIG. 1 in the fully raised position when viewed from below.

The gas strut cable 22 is connected to the head of the piston 71 of the gas strut, as can be seen in FIG. 5, since the head of the piston remains stationary relative to the gas strut handle 30, however the cable 22 could be connected to the main body of the gas strut if the resulting movement in the cable 22 was accommodated, or if the main body of the gas strut was instead connected to the mounting bracket 15 and the piston 71 connected to the shuttle 60.

The retainer handle 30 is connected to the retainer pin 31 by the cable 32, so the retainer handle can be actuated to withdraw the retainer pin 31 from one of the holes 63 and allow the shuttle 60 to slide. When the retainer handle 30 is not actuated, the retainer pin 31 enters one of the holes 63 of the shuttle 60 under the influence of a spring bias 33, and keeps the shuttle in position. In this embodiment, there are sixteen different holes aligned along the length of the shuttle 60 along the direction in which the shuttle 60 slides, and so there are 16 different positions in which the desktop 10 can be held relative to the base frame 50. Clearly, different numbers of holes 63 may be implemented depending on how finely the position of the desktop 10 is to be allowed to be set.

To move the shuttle 60, both the retainer handle 30 and the gas strut handle 20 must be actuated at the same time as one another. The holes 63, retainer pin 31, spring bias 33, cable 32, and retainer handle 30 together constitute a retainer device that retains the shuttle 60 in position unless the retainer device is actuated. The retainer device relieves the gas strut 70 from having to support all the weight of and upon the desktop 10 when the desktop is being used.

The schematic diagram of FIG. 5 is taken from beneath the height adjustable desk 5, in a direction BS marked on FIG. 4. The desktop 10 is fully raised above the base frame 50, and the shuttle 60 is visible in FIG. 5 at its maximum rearward extent, with the rails 14 exposed at the front side of the desktop 10. The helical torsion spring 48 is also visible between the first and second support members 48. FIG. 5 also shows how the pivot 46, which connects the lower ends of the second support member 45 to the rails 55, is supported by a pivot support plate 46*a* that joins the lowermost ends of the second support members 45 together and provides structural support to the second support members.

FIG. 5 also shows further details of the gas strut handle 20 and the retainer handle 30. As mentioned previously these handles are the same as one another, except for that they are mirror images of one another. Therefore, the following description applies equally to both of the handles. Each handle comprises the grip portion 80 (shown in FIG. 1), and further comprises a bottom portion 82 which is connected to the grip portion 80 by a pivot portion 81 that passes through a hole in the desktop 10. The pivot portion allows the handle to be rotated within the hole through the desktop, passing the rotational motion exerted by the user on the grip portion 80 to the bottom portion 82. The grip portion 80 is above the desktop 10, and the bottom portion is below the desktop 10.

The bottom portion comprises the skirt portion 83 that extends downwardly from the desktop 10 and overlaps the base frame 50 outside of the side members 51*a* and 51*b* of the base frame 50 when the desktop 10 is moved into its lowermost position. Optionally, the skirt portion 83 may extend downwardly by far enough to contact the existing desktop 1 when the desktop 10 is moved into its lowermost position, to further cushion the desktop 10 when it reaches its lowermost position.

The bottom portion 82 also comprises an anchor point 84 to which the end of the cable 22 or 32 is attached. The anchor point 84 is rearward of the pivot portion 81, so that when the handle is actuated, the cable is tightened and drawn away from the gas strut 70 or shuttle 60. The bottom portion 82 also comprises a latch 87 at one end of the bottom portion 82, the latch being rearward of the pivot portion 81. The bottom portion 82 also comprises an extension portion 82*a*, which extends forwardly of the pivot portion 81, and ends with a further latch 86 at an opposite end of the bottom portion 82 from the latch 87. The further latch 86 is supported by a bracket 17 that is mounted on the underside of the desktop 10, and the bracket also prevents the handle from being rotated too far by the user when the handle is actuated.

The function of the latches and further latches of the handles is to latch against the side members 51*a* and 51*b* when desktop 10 is moved into its lowermost position, to lock the desktop 10 into that position and to keep the desktop 10 horizontal, rather than allowing it to slope under the influence of the gas strut or the springs 13 or 48. In FIG. 5 where the desktop 10 is in its uppermost position the latches 87 and 86 are unlatched.

The schematic diagram of FIG. 6 is also taken from beneath the height adjustable desk 5, in the direction BS marked on FIG. 4, but in contrast to FIG. 5, the desktop 10 is shown in the lowermost position in FIG. 6 rather than the uppermost position of FIG. 5. The shuttle 60 is visible in FIG. 6 at its maximum forward extent, with the rails 14 exposed at the rear side of the desktop 10, and the periphery of the desktop 10 being coincident with the periphery of the base frame 50. As shown, the latch 87 latches against the outer side of the left side member 51*a*, and the further latch 86 latches against the inner side of the left side member 51*a*, to help keep the desktop 10 in a horizontal orientation, i.e. in a plane parallel to the plane defined by the front 52*a*, rear 52*b*, left side 51*a*, and right side 51*b* members.

Figure 7:
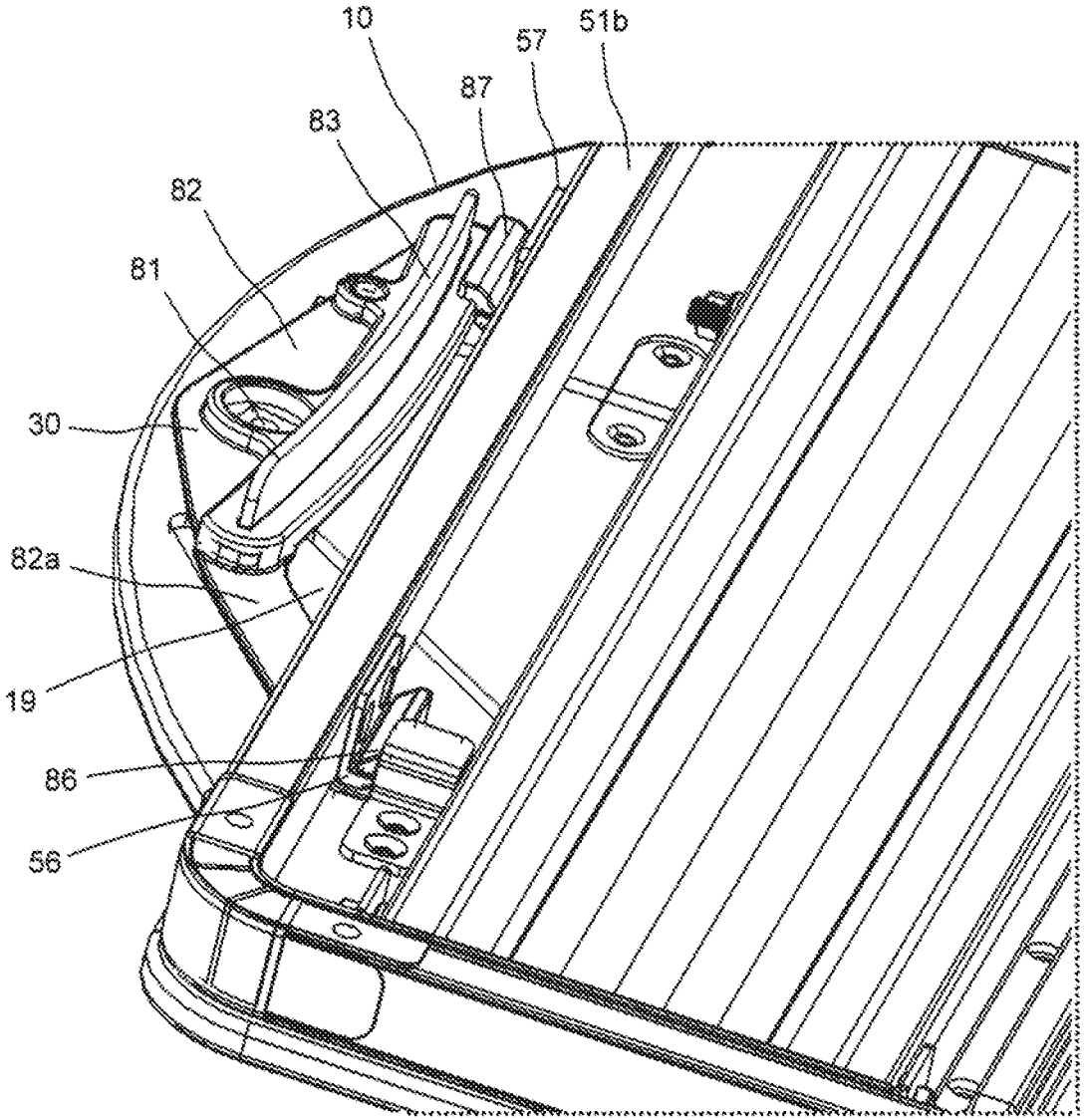
FIG. 7 shows a schematic perspective diagram of a portion of the height adjustable desk of FIG. 1 in the fully lowered position when viewed from below, the portion including a retainer handle.

A close-up view of the retainer handle 30 in which the latch 87 and further latch 86 can be seen more clearly, is shown in FIG. 7. Specifically, the latch 87 latches over a horizontally extending portion of an L-shaped bracket 57 that is fixed to the outside surface of the right side member 51*b*, and the further latch 86 latches over a horizontally extending portion of an L-shaped bracket 56 that is fixed to the inside surface of the right side member 51*b*. It will be appreciated that actuating the retainer handle 30 by rotating it anticlockwise in the orientation shown in FIG. 7, will release the latch 87 and further latch 86 from the brackets 57 and 56, and will pull the cable 22 to withdraw the retainer pin 31 from the hole 63, so that the desktop can be raised upwardly, if the gas strut handle 20 is rotated at the same time to release its latches and actuate the gas strut.

The L-shaped brackets 56 and 57 are also designated in FIG. 4, it being understood that both the left side member 51*a* and the right side member 51*b* have the L-shaped brackets 56 and 57 for the latches of the corresponding handles 20 and 30.

Figure 8:
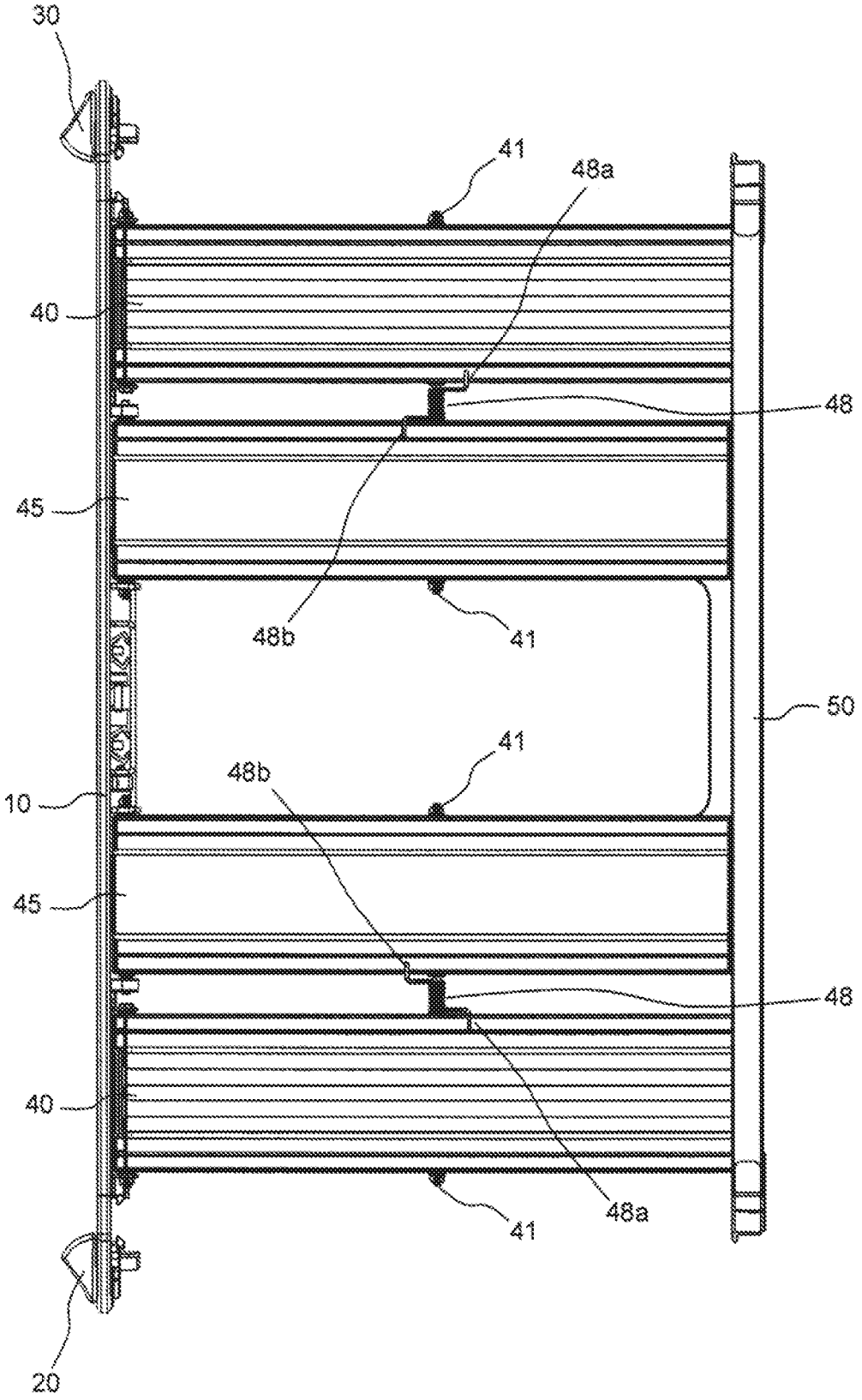
FIG. 8 shows a schematic side elevation diagram of the height adjustable desk of FIG. 1 in the fully raised position when viewed from the rear.

Another schematic diagram of the height adjustable desk 5 is shown in FIG. 8, and this is taken looking at the rear of the height adjustable desk when the desktop 10 is fully extended from the base frame 50. This diagram allows the helical torsion springs 48 to be seen in more detail. Specifically, each spring 48 comprises a plurality of coils around the corresponding pivot 41, and opposing end portions 48*a* and 48*b*. The end portion 48*a* abuts against the rear face of the first member 40, and the end portion 48*b* abuts against the rear face of the second member 45. Accordingly, when the desktop 10 is moved downwardly towards the base frame 50, the end portions 48*a* and 48*b* are forced to rotate towards one another, exerting a force which acts against the motion of the desktop 10 downwardly towards the base frame 50.

Many other variations of the described embodiments falling within the scope of the invention will be apparent to those skilled in the art. For example, the handles 20 and/or 30, and/or the shuttle 60 and gas strut 70, could be mounted on the base frame 50 instead of the underside of the desktop 10 if desired.

The invention claimed is:

1. A height adjustable desk for placing on an existing desktop, the height adjustable desk comprising a base frame for placing on the existing desktop, a desktop that is connected to the base frame by first and second support members, and a gas strut, wherein the first and second support members are pivotally connected to one another and are pivotable about the pivotal connection to raise and lower the desktop from the base frame, wherein the height adjustable desk has a front side, a rear side, and a top side formed by the desktop, wherein a lower end of the first support member is pivotally connected to the base frame at the front side of the height adjustable desk, and an upper end of the first support member is pivotally connected to the desktop at the rear side of the height adjustable desk, wherein a lower end of the second support member is slidable along the base frame, and an upper end of the second support member is slidable along the desktop, wherein the upper or lower end of the second support member is pivotably connected to a shuttle, the shuttle being drivable by the gas strut to slide along a shuttle frame of the desktop or base frame, wherein the shuttle is provided with a retainer device for retaining the shuttle at a selected one of a plurality of alternate positions along the shuttle frame, each alternate position corresponding to a respective height of the desktop above the base frame, and wherein the retainer device comprises a retainer handle, the retainer handle being actuable to release the shuttle from the selected one of the plurality of alternate positions along the shuttle frame, allowing the shuttle to be slid to another one of the plurality of alternate positions.

2. The height adjustable desk of claim 1, further comprising a spring that biases the pivotal connection of the first and second support members towards raising the desktop upwardly from the base frame.

3. The height adjustable desk of claim 2, wherein the first and second support members are pivotally connected to one another by a pivot, wherein the spring is a coiled spring, and wherein the pivot passes through the coils of the coiled spring.

4. The height adjustable desk of claim 1, wherein the end of the second support member opposite to the end pivotally connected to the shuttle, is slidable along support rails of the desktop or base frame, the support rails preventing movement of that end of the second support member relative to the support rails in the height direction.

5. The height adjustable desk of claim 1, wherein the desktop or the base frame comprises a damper spring, wherein the damper spring is configured to come into contact with the first or second member as the desktop is lowered to the base frame, to bias the desktop upwardly away from the base frame.

6. The height adjustable desk of claim 5, wherein the damper spring is a spring member with a curved middle portion and two opposing ends that are connected to either the desktop or the base frame, the curved middle portion configured to bear against the first or second member when the desktop is fully lowered to the base frame.

7. The height adjustable desk of claim 1, wherein the gas strut comprises a gas strut handle, the gas strut handle being actuable to cause the gas strut to drive the shuttle along the shuttle frame, to raise the desktop from the base frame.

8. The height adjustable desk of claim 7, wherein the gas strut is configured to maintain the shuttle in a fixed position except for during actuation of the gas strut handle.

9. The height adjustable desk of claim 7, wherein the gas strut handle comprises a latch that is configured to latch against the base frame when the desktop is fully lowered to the base frame, and to release when the gas strut handle is actuated to allow the desktop to rise up from the base frame.

10. The height adjustable desk of claim 9, wherein the gas strut handle is pivotally mounted to the desktop, and has a bottom portion extending beneath the desktop, the bottom portion comprising the latch at one end of the bottom portion, and a further latch at an opposite end of the bottom portion, wherein the latch and the further latch are configured to latch against opposing sides of a base member of the base frame when the desktop is fully lowered to the base frame, and to release when the gas strut handle is actuated to allow the desktop to rise up from the base frame.

11. The height adjustable desk of claim 7, wherein the gas strut handle comprises a skirt portion that extends downwardly from the desktop and which prevents entry of a user's fingers between the desktop and the base frame when actuating the gas strut handle.

12. The height adjustable desk of claim 7, wherein the gas strut handle comprises a grip portion that is mounted on top of the desktop, and which is graspable by a user to actuate the gas strut handle.

13. The height adjustable desk of claim 1, wherein the gas strut comprises a gas strut handle, the gas strut handle being actuable to cause the gas strut to drive the shuttle along the shuttle frame, to raise the desktop from the base frame, wherein the gas strut handle and the retainer handle are positioned at opposite sides of the height adjustable desk to one another, such that two hands are required to simultaneously actuate the gas strut handle and the retainer handle.

14. The height adjustable desk of claim 1, wherein the retainer device comprises a retainer pin controlled by the retainer handle, and a plurality of holes in the shuttle for receiving the retainer pin, the plurality of holes corresponding to respective ones of the plurality of alternate positions, wherein the retainer pin is spring biased into the hole corresponding to the selected position, and wherein the retainer handle is actuable to move the pin against the spring bias and out of the hole corresponding to the selected position, to release the shuttle.

15. The height adjustable desk of claim 1, wherein the retainer handle comprises a latch that is configured to latch against the base frame when the desktop is fully lowered to the base frame, and to release when the retainer handle is actuated to allow the desktop to rise up from the base frame.

16. The height adjustable desk of claim 15, wherein the retainer handle is pivotally mounted to the desktop, and has a bottom portion extending beneath the desktop, the bottom portion comprising the latch at one end of the bottom portion, and a further latch at an opposite end of the bottom portion, wherein the latch and the further latch are configured to latch against opposing sides of a base member of the base frame when the desktop is fully lowered to the base frame, and to release when the retainer handle is actuated to allow the desktop to rise up from the base frame.

17. The height adjustable desk of claim 1, wherein the retainer handle comprises a skirt portion that extends downwardly from the desktop and which prevents entry of a user's fingers between the desktop and the base frame when actuating the retainer handle.

18. The height adjustable desk of claim 1, wherein the retainer handle comprises a grip portion that is mounted on top of the desktop, and which is graspable by a user to actuate the retainer handle.

* * * * *